US006521114B1

(12) United States Patent
Kempin

(10) Patent No.: US 6,521,114 B1
(45) Date of Patent: Feb. 18, 2003

(54) PREVENTION OF MARINE ENCRUSTATION ON BRONZE PROPELLERS

(75) Inventor: Ronald Kempin, Bull Creek (AU)

(73) Assignee: Propeller Antifouling Pty Ltd., Hamilton Hill (AU)

( * ) Notice: Subject to any disclaimer, the term of this patent is extended or adjusted under 35 U.S.C. 154(b) by 0 days.

(21) Appl. No.: 09/242,534

(22) PCT Filed: Aug. 21, 1997

(86) PCT No.: PCT/AU97/00543

§ 371 (c)(1),
(2), (4) Date: May 11, 1999

(87) PCT Pub. No.: WO98/07897

PCT Pub. Date: Feb. 26, 1998

(30) Foreign Application Priority Data

Aug. 22, 1996 (AU) ..... PO 1086

(51) Int. Cl.[7] ..... C25D 5/48

(52) U.S. Cl. ..... 205/194; 148/269; 148/282; 148/284; 205/206; 205/220

(58) Field of Search ..... 205/149, 191, 205/194, 215, 206, 220, 223; 148/269, 282, 284

(56) References Cited

U.S. PATENT DOCUMENTS 3,426,473 A * 2/1969 Cardarelli et al. ..... 43/131
3,458,413 A * 7/1969 Ueda et al ..... 205/724
3,497,434 A * 2/1970 Littauer ..... 205/704
4,203,809 A * 5/1980 McKean ..... 204/32 R
4,954,185 A * 9/1990 Kohm ..... 148/282
5,080,926 A * 1/1992 Porter et al. ..... 427/34
5,626,736 A * 5/1997 Florio et al. ..... 205/125

* cited by examiner

*Primary Examiner*—Nam Nguyen
*Assistant Examiner*—William T. Leader
(74) *Attorney, Agent, or Firm*—Connolly Bove Lodge & Hutz LLP

(57) ABSTRACT

From the time that they are immersed into a marine environment, bronze propellers are prone to attack by marine organisms, such as barnacles, coral and algae, which attach themselves to the bronze metallic surface, creating lumps on the propeller, which adversely affect its balance and cause impedance and vibration of the propeller and its boat in the water. Anti-fouling paints are either too toxic for the marine environment or lack smoothness on the surface. These problems have been overcome by polishing the propeller to prepare it for electroplating, cleansing to remove dirt and grease, electroplating with copper, followed by spraying with a standard solution (5%) of sodium hypochlorite and sodium chloride and allowing sufficient time for a reaction of the hypochlorite solution with the copper to form a firmly adhering conversion coating of basic cupric chloride. The coating is blue-green in color.

21 Claims, No Drawings

PREVENTION OF MARINE ENCRUSTATION ON BRONZE PROPELLERS

This invention relates to a process for the prevention of marine encrustation on components used in a marine environment and in particular although not exclusively bronze or copper components, such as bronze propellers. Bronze includes tin bronze, aluminium bronze, silicon-aluminium bronze, nickel-aluminium bronze and manganese bronze.

A problem with components that are submerged in a marine environment for extended periods is that marine life encrustation can develop on the surface of the component. This is particularly a problem with propellers. In operation, water travels over the propeller blades at high velocity, it is essential for the efficiency of the propeller, that the surface be perfectly smooth, even and true. From the time that they are immersed into a marine environment, bronze propellers are prone to attack by marine organisms, such as barnacles, coral and algae, which attach themselves to the bronze metallic surface, creating lumps on the propeller, which adversely affect its balance and cause impedance and vibration of the propeller and its boat in the water. Various remedies have been tried including anti-fouling paints. One of these paints containing tributyl tin, was so toxic to other economic marine life, such as oysters, that it had to be discontinued. Its successor is so aggressive, that its application to the finely polished surface of the bronze leaves brush marks in the form of grooves, that adversely affect the fine balance and vibration free performance of the propeller. Durability of the anti-fouling paint on the propeller can be as short as 30 days in active marine environments.

Accordingly, the inventive process seeks to provide protection from marine encrustation for an extended period of time.

In accordance with the present invention there is provided a process for improving the resistance to marine encrustation of a component used in a marine environment, including the step of treating the component with a hypochlorite or a hypochlorite-containing material or a precursor thereof.

Preferably, the component is made from copper, contains copper or is provided with a surface layer of copper or copper-containing material. More preferably, the process further includes forming a layer of copper or copper-containing material on the surface of the component before treatment by the hypochlorite material, particularly if the surface of the component is not copper or is not provided with a copper or copper-containing surface.

Preferably, the hypochlorite material is a hypochlorite salt solution or a material capable of forming a hypochlorite salt solution.

Preferably, a cupric chloride coating is formed on the surface of the component by treating the copper surface or copper surface layer of the component with the hypochlorite salt solution.

Preferably, the component is metallic and the copper layer is formed on the metallic surface by electroplating. More preferably, the copper layer is formed to a minimum depth of 0.06 millimetres. Typically the component or the surface of the component is or includes bronze before being electroplated with copper.

Preferably, a process according to claim 6, wherein the bronze surface is cleansed before electroplating.

Preferably, the copper surface is exposed to the hypochlorite salt solution for a period of time sufficient for the basic cupric chloride coating to form.

Preferably, the hypochlorite salt solution is a standard sodium hypochlorite solution containing 5% sodium hypochlorite and 5% sodium chloride.

Preferably, the hypochlorite salt solution is applied, preferably sprayed onto the copper surface or copper layer.

Preferably, the surface of the component is polished before it is cleansed.

Preferably, the step of forming the basic cupric chloride coating is preceded by the formation of cupric oxide.

Preferably, the component is a bronze propeller. More preferably, the bronze propeller is a newly cast bronze propeller that has been first polished to propeller production standard. Preferably, wherein the polishing procedure incudes using a 60# grit size at 3500 sfm for roughing, followed by using a 180# grit size at 5500 sfm for finishing the propeller using grease as a polishing aid.

Preferably, the surface cleansing includes one or more steps of alkaline cleaning by dipping or electrolytic means, vapour degreasing and solvent cleaning.

Preferably, the copper layer is electroplated using an electroplating bath which is alkaline. More preferably, the copper electroplating bath is an alkaline cyanide bath. Alternatively, the copper electroplating bath is an alkaline pyrophoshate bath.

Alternatively, the copper layer is electroplated using an electroplating bath which is acid. Preferably, the copper electroplating bath is an acid sulphate bath. Preferably, the copper electroplating bath is an acid fluoborate bath.

In accordance with another aspect of the present invention there is provided a component having increased resistance to marine encrustation in a marine environment, wherein the surface of the component has been treated with a hypochlorite or hypochlorite-containing material or precursor thereof, after which the component is provided with a basic cupric chloride coating.

Preferably, the component is made from copper, contains copper or is provided with a surface layer of copper or copper-containing material on which the basic cupric chloride coating is formed. More preferably, the copper or copper-containing surface is a layer formed on a metallic surface of the component. Still more preferably, the metallic surface is a bronze surface of the component: Typically, the component is a bronze propeller.

Preferably, the layer is an electroplated layer.

Preferably, the basic cupric chloride coating is a cupric oxy-chloride coating. More preferably, the basic cupric chloride coating is a cupric chloro-hypochlorite coating.

In order to provide a better understanding of the present invention, a embodiment will now be described in detail. The preferred embodiment is described in relation to bronze propellers, however it will be appreciated that the invention is applicable to other components.

The process for the prevention of marine encrustation on bronze surfaces, in particular those of propellers, is characterised by the following steps:

(a) The cast propeller is first polished to the propeller production standard.

(b) The whole polished propeller is then cleansed, to remove all traces of dirt and grease.

(c) The cleansed propeller is then electroplated with copper preferably to a depth of about 0.002" or 0.06 mm.

(d) The electroplated propeller is then placed in a suitable container and sprayed with a standard solution of sodium hypochlorite.

Thereafter, only minimum maintenance is required, when the vessel is slipped periodically, thus providing a substantial reduction in maintenance costs.

The first step in the preparation is polishing. Bronze propellers and associated structure are typically sand cast and require polishing to remove scale. Reference top this procedure may be found in the article "Mechanical Finishing—Polishing and Buffing". The recommended procedure is 60# grit size at 3500 sfm for roughing, followed by 180# grit size at 5500 sfm for finishing using grease as a polishing aid.

The second step in the procedure consists of surface preparation or cleansing to remove all traces of dirt and grease and may consist of one or more of alkaline cleaning by dipping or electrolytic means, vapour degreasing and solvent cleaning in the article [2]"Metal Cleaning—Section of Cleaning Process". This surface preparation is also the subject of standard ASTM B281—"Preparation of Copper and Copper Base Alloys for Electroplating".

The third step involves electroplating the cleansed propeller with copper to a depth of, for example 0.002" or 0.06 mm. Various salts of copper may be used, but the most common are those of the two alkaline (cyanide and pyrophosphate) baths and the two acid (sulphate and fluoborate) baths. These are variously described in [3]"Copper Plating" by Mattie F. McFadden and are the subject of two standards AMS 2418 and MII,-C-14550(Ord). As well as provided an appropriate surface for subsequent processing, electroplating with copper enhances the surface by providing a substantial levelling effect ranging from 70 to 90 per cent for a deposit of 0.005" in thickness.

The fourth step in the process consists of placing the electroplated propeller in a suitable container and spraying the electroplated surface with sodium hypochlorite solution. This solution is prepared by chlorination of sodium hydroxide (caustic soda) solution $$2NaOH+Cl_2 \rightarrow NaCl+NaClO+H_2O$$

or, alternatively, by electrolysis of a sodium chloride (common salt) solution and reacting the product of the anode (chlorine) with the product of the cathode (sodium hydroxide). Sodium hypochlorite is routinely marketed as a 5% equimolecular solution of sodium chloride and sodium hypochlorite for the disinfection and sterilisation of such places as dairies and milking sheds under various trade names such as Eau de Javelle, Chlorox and Dazzle. The reactions with take place with the copper surface are believed to be $$Cu+NaClO \rightarrow CuO+NaCl \quad -(1)$$

(black)

(2)

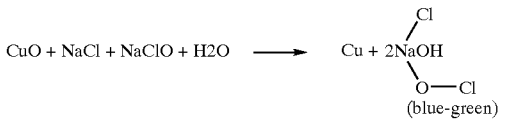

A first coating of black cupric oxide is formed in reaction (1), which coating is then converted to a blue-green basic cupric chloride in reaction (2). The basic cupric chloride forms a firmly adherent coating, which resists the encroachment of marine organisms. A life expectancy of five years of effective protection against. marine growth has been achieved, providing ultimate thrust to manufacturers' standards, together with precise balance and vibration-free performance.

It will be apparent to persons skilled in the relevant arts that modifications and variations can be made to the described invention without departing from the basic inventive concepts, such as:

(i) the surface treated to form the basic cupric chloride coating may already be copper and therefore copper electroplating may not be necessary;

(ii) a component may not necessarily be bronze, so long as it is electroplated with copper on which is formed the basic cupric chloride coating;

(iii) a standard solution of sodium hypochlorite may be substituted with other hypochlorite salt solutions; and, (iv) the hypochlorite salt solution may be applied in various other ways to the copper surface than spraying, such as painting or dipping.

All such modifications and variations as would be apparent to a skilled addressee are intended to be included with the scope of the present invention, the nature of which is to be determined from the foregoing description and appended claims.

BIBLIOGRAPHY

[1,2,3] Metals Handbook, 8th edit., Vol. 2-"Heat Treating, Cleaning and Finishing". (ASM, Metals Park, Ohio 1964).

What is claimed is:

1. A process for improving resistance to marine encrustation of a component used in a marine environment including the steps of:

providing a component adapted for use in a marine environment, said component having an outer surface substantially covered with copper;

applying a hypochlorite solution to said outer surface; and allowing sufficient time for a reaction of said hypochlorite solution with the copper to form a blue-green layer at the outer surface, wherein the blue-green layer formed at the outer surface resists marine encrustation of said component in a marine environment.

2. A process in accordance with claim 1, wherein the hypochlorite solution is a hypochlorite salt solution or a material capable of forming a hypochlorite salt solution.

3. A process according to claim 2, wherein the hypochlorite salt solution is a sodium hypochlorite solution containing 5% sodium hypochlorite and 5% sodium chloride.

4. A process in accordance with claim 1, wherein the blue-green layer includes a basic cupric chloride.

5. A process according to claim 1, wherein the step of applying the hypochlorite material is performed by spraying the hypochlorite material onto the component.

6. A process for improving resistance to marine encrustation of a component used in a marine environment including the steps of:

providing a component adapted for use in a marine environment;

applying a layer of copper or a substantially copper-containing material to an outer surface of the component;

applying a hypochlorite solution to said outer surface; and allowing sufficient time for a reaction of said hypochlorite solution with the copper to form a blue-green layer at the outer surface, wherein the blue-green layer formed at the outer surface resists marine encrustation of said component in a marine environment.

7. A process in accordance with claim 6, wherein the step of applying a layer of copper or substantially copper-containing material is conducted by electroplating.

8. A process in accordance with claim 7, wherein the electroplating forms a layer of copper or copper-containing material with a minimum depth of 0.127 mm.

9. A process in accordance with claim 7, wherein the outer surface is cleaned prior to electroplating.

10. A process according to claim 9, wherein the surface cleaning includes one or more steps of alkaline cleaning by dipping or electrolytic means, vapour degreasing and solvent cleaning.

11. A process according to claim 7, wherein the surface of the component is polished before it is cleaned.

12. A process according to claim 7, wherein the layer of copper or copper-containing material is electroplated using an electroplating bath which is alkaline.

13. A process according to claim 12, wherein the copper electroplating bath is an alkaline cyanide bath.

14. A process according to claim 12, wherein the copper electroplating bath is an alkaline pyrophosphate bath.

15. A process according to claim 7, wherein the copper layer is electroplated using an electroplating bath which is acid.

16. A process according to claim 15, wherein the copper electroplating bath is an acid sulphate bath.

17. A process according to claim 15, wherein the copper electroplating bath is an acid fluoroborate bath.

18. A process in accordance with claim 6, wherein the component is or includes bronze.

19. A process according to claim 18, wherein the component is a bronze propeller.

20. A process according to claim 19, wherein the bronze propeller is a newly cast bronze propeller that has been first polished to propeller production standard.

21. A process according to claim 20, wherein the polishing procedure includes using a 60# grit size at 3500 sfm for roughing, followed by using a 180# grit size at 5500 sfm for finishing the propeller using grease as a polishing aid.

* * * * *